United States Patent [19]

Belcher

[11] Patent Number: 5,056,176

[45] Date of Patent: Oct. 15, 1991

[54] CUTTER ASSEMBLY FOR ROTARY DRAIN CLEANER

[76] Inventor: Walter C. Belcher, 20068 Poncianna, Redford, Mich. 48240

[21] Appl. No.: 471,481

[22] Filed: Jan. 29, 1990

[51] Int. Cl.[5] ..... B08B 9/02

[52] U.S. Cl. ..... 15/104.10 R; 15/104.33

[58] Field of Search ..... 15/104.05, 104.09, 104.1 R, 15/104.11, 104.31, 104.33; 134/8

[56] References Cited

U.S. PATENT DOCUMENTS

| | | | |
|---|---|---|---|
| 3,171,149 | 3/1965 | Ciaccio | 15/104.09 |
| 3,283,353 | 11/1966 | Kirk | 15/104.33 |
| 4,376,321 | 3/1983 | Dudley | 15/104.33 |
| 4,666,530 | 5/1987 | Houser | 15/104.33 |
| 4,926,518 | 5/1990 | Mikol | 15/104.33 |

*Primary Examiner*—Edward L. Roberts

[57] ABSTRACT

Rotary drain cleaning apparatus includes a synthetic polymeric cutter blade adapted to be mounted onto a drain cleaning cable fabricated from, or coated with, a synthetic polymeric material. Use of such a cutter and cable avoids damage to polymeric drain lines during a cleaning operation.

9 Claims, 2 Drawing Sheets

CUTTER ASSEMBLY FOR ROTARY DRAIN CLEANER

FIELD OF THE INVENTION

This invention relates generally to rotary drain cleaners of the type adapted to rotatably advance a cable or snake through a drain line. In particular, the invention relates to an improved cutter head and snake for use with such an apparatus and most specifically to a cutter head and snake adaptable for use in polymeric drain lines of the type used in subsoil drainage systems.

BACKGROUND OF THE INVENTION

It has been said that the plumber is the safe guard of the health of a nation. This is evidenced by the fact that the major reason for the decrease in infectious disease in more technologically advanced civilizations is the presence of adequate plumbing, sewage and drainage systems. .While the benefits of modern plumbing are without dispute, such systems require periodic maintenance and cleaning to retain their proper operation.

Sewers, drains and other underground lines are particularly prone to clogging by sewage effluents or by penetration of tree roots and the like thereinto. Such obstructions can decrease the flow of liquid through the line resulting in loss of drain function and a back-up of sewage or waste water into a dwelling place. Because of the tendency of such drain lines to clog, it is necessary to periodically employ cleaning apparatus to remove the obstructions. The most commonly employed type of drain cleaner is a rotary cleaning apparatus comprised of a base having a motor mounted thereupon and adapted to rotate and advance a springlike cable or snake through the drain line. Generally the cable is fitted with a cutting head having one or more sharpened blades thereupon and adapted to sever and/or macerate any obstruction in the line. Such apparatus are well known to those of skill in the art and sold by a variety of manufacturers as for example the Ridge Tool Company of Elyria, OH.

Presently, polymeric drain line is enjoying ever increasing use both for sewage handling and for subsurface drain lines. Such drain lines are fabricated from durable polymeric materials such as polyvinyl chloride, (PVC); acrylonitrile butadiene styrene copolymer, ABS; high density polyethylene and similar materials. Such plastic drain lines offer advantages over heretofore employed metallic or ceramic lines insofar as the material is relatively light, easy to cut and fasten and not prone to corrosion damage.

While polymeric drain lines confer many advantages, problems occur when attempts are made to clean such lines with heretofore employed drain cleaning tools. Previous to the present invention cutters for rotary drain cleaners and snakes used to drive such cutters were fabricated from steel and tended to damage polymeric drain lines. In some instances, metallic drain cleaning tools can actually pierce a polymeric drain line resulting in a potential health hazard as well as necessitating a costly repair. In other instances, damage done by metallic cleaning tools can be more insidious. Such tools are capable of gouging or scraping the interior surface of a polymeric drain line so as to cause a weak spot subject to later failure or they may create a roughened or scarred surface which is prone to the collection of debris and the subsequent formation of a stoppage.

Accordingly, it will be appreciated that there is a need for drain cleaning apparatus adapted to reliably and safely clean polymeric drain lines without causing damage thereto. It is further desirable that any such equipment be compatible with heretofore available rotary drain cleaning apparatus.

U.S. Pat. No. 3,195,548 discloses a generally polymeric sewer opener configured as a flexible, preferably water carrying hose having a guide head thereupon fabricated from a number of plastic spheres. The sewer pipe opener of the '548 patent is not adapted to be used with a rotary sewer cleaning apparatus and is not capable of either penetrating long distances through an underground line or cutting its way through debris.

Accordingly there is a need for a sewer or drain cleaning apparatus which can be used with conventional cleaning equipment, and which can be rotatably advanced along lengths of drain lines, particularly polymeric drain lines, without causing any damage thereto. According to the present invention there is provided a cutter which may be employed with heretofore available rotary drain cleaning apparatus, which cutter is not capable of damaging polymeric drain lines. These and other advantages of the present invention will be apparent from the drawings, description and discussion which follow.

BRIEF SUMMARY OF THE INVENTION

There is disclosed herein an improved cutter assembly for use with a drain cleaning apparatus of the type adapted to rotatably advance a cable through a drain line. The cutter assembly is comprised of at least one cutter blade fabricated from a synthetic polymeric material and a connector adapted to affix a cutter assembly to the cable and rigidly retain at least one cutter blade therein. Because of the plastic blade, the assembly is particularly well adapted to clean a polymeric drain line without damage thereto.

In one particular embodiment of the invention, the cutter assembly includes a plurality of blades. .In accord with yet other embodiments, the cutter blades may be affixed to the connector so as to be replaceable. .The cutter blade speed may be fabricated from a wide variety of polymeric materials including materials such as ABS, PVC, ABS-PVC combinations, polycarbonates, polyethylene terepthalate, nylon, epoxies and combinations thereof. In some instances the polymeric material may be advantageously reinforced with another material such as metal particles, glass fibers, glass cloth, graphite fibers and the like. In yet other instances, the cutter blade may be fabricated as a metallic member having a polymeric coating thereupon. In yet other instances the cutter of the present invention may include a secondary metallic blade in addition to the polymeric blade, the metallic blade disposed so as to limit the amount of deleterious contact it can establish with a drain line in which it is operative.

The connector may be a metallic member adapted to receive and retain the cutter blade whereas in other instances the connector may be fabricated from a polymeric material.

DETAILED DESCRIPTION OF THE INVENTION

Figure 1:
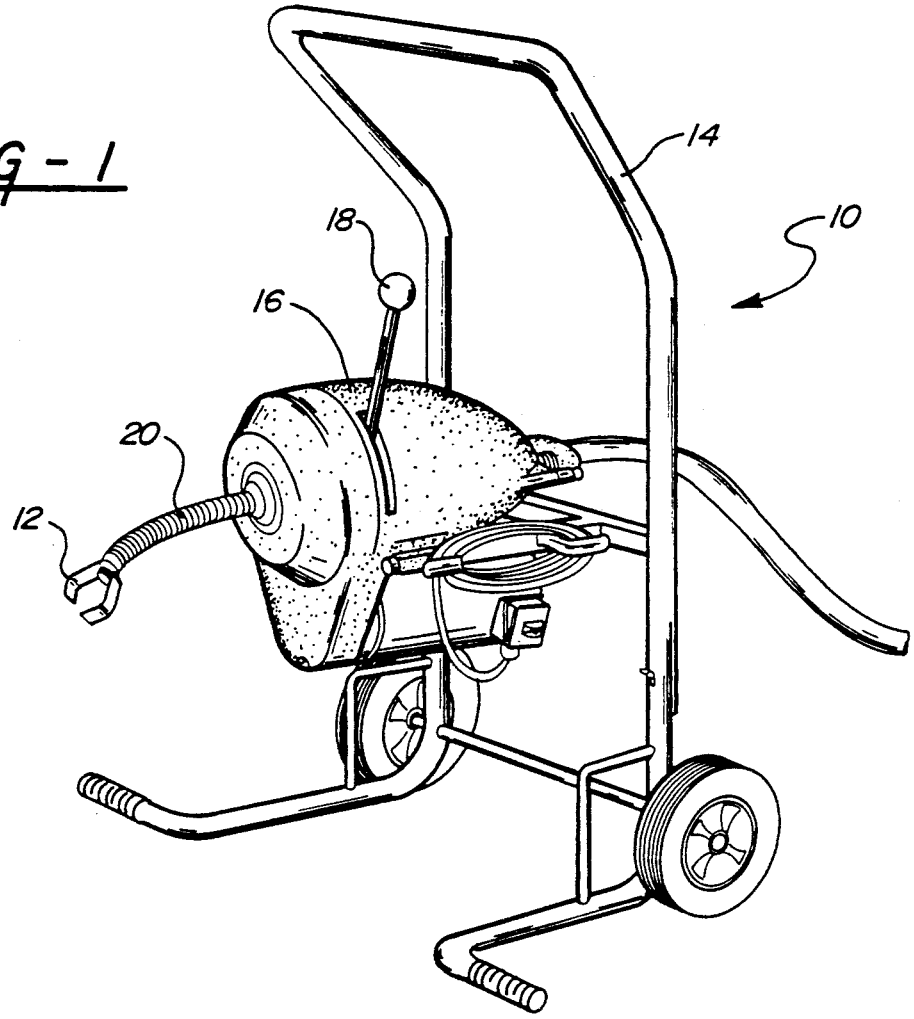
FIG. 1 is a perspective view of a rotary drain cleaning apparatus including the improved cutter blade of the present invention.

Referring now to FIG. 1, there is shown a generalized depiction of a rotary drain cleaning apparatus 10 including the cutter head 12 of the present invention. The apparatus 10 is mounted upon a wheeled stand 14 and includes an electric motor 16 capable of rotating in a clockwise or counterclockwise direction. The motor is engaged to a snake or cable 20 by means of a clutch lever 18. The apparatus 10 is adapted to receive a snake or cable 20 therein and to advance and rotate that cable.

Toward that end, the cable 20 is configured as a generally elongated, springlike member and the motor 16 cf the apparatus 10 is adapted to engage the helical coils of the springlike cable 20 so as to rotate and advance that cable through a drain line. The cable is provided with connectors on either end thereof and as successive portions are advanced through a drain, additional cable sections may be readily attached. The advance of the rotating cable 20 through the drain line rotates the cutter 12 thereby freeing debris from the walls of the drain line. Various modifications of the foregoing apparatus are known to those of skill in the art and may include integral drum storage for cable, provisions for flushing the drain line with water, variable speeds and other such features In operation, the rotary cleaner 10 is provided with a source of electrical power to energize the motor 16, and the motor is activated in a forward direction and the clutch lever 18 engaged to cause the cable 20 to advance through the drain line, so as to encounter and dislodge the obstructions. When the obstruction has been cleared, the lever 18 is reversed to facilitate withdrawal of the cable 20.

Figure 2:
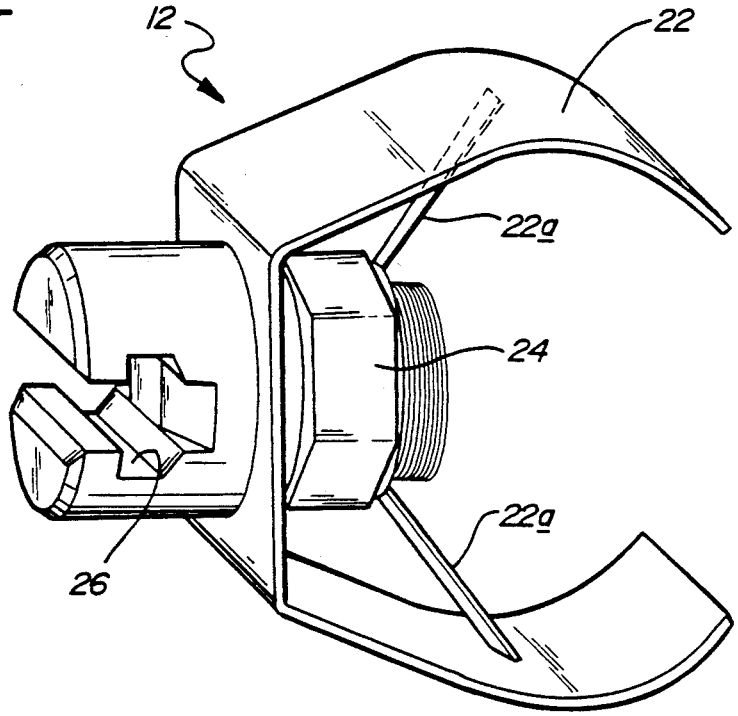
FIG. 2 is a more detailed view of a cutter blade of the present invention.

Referring now to FIG. 2, there is shown a more detailed drawing of a cutter head 12 structured in accord with the principles of the present invention, and including a cutter blade 22 fabricated from a synthetic polymeric material. There are presently available a wide variety of durable, resilient polymers which may be employed to fabricate the cutter blade. Included among such materials are ABS, PVC, ABS-PVC blends, polycarbonates, epoxies, nylons and the like. It has in fact been found, in accord with the principles of the present invention, that many of these materials can retain a relatively sharp edge and have sufficient durability and resiliency to function as cutting tools.

Great advances have been made in composite materials and it has been found that the desirable mechanical properties of the foregoing materials may be even more significantly increased by incorporation of various inorganic filler materials therein. For example, aluminum filled novalak type epoxy resins have a flexural strength of 8,500–24,000 psi and a compressive strength of 13,000–33,000 psi. Glass filled, high strength novalak resins have a structural strength of 50,000–70,000 psi and a compressive strength of 30,000–38,000 psi. Nylon, type with 30–35% glass fiber reinforcement exhibits a flexural. 25 strength of 33,000–21,000 psi and a compressive strength of 19,000–23,000 psi. Nylon type 6/6 reinforced with 30% graphite fiber has a flexural strength of 45,000–51,000 psi and a compressive strength of 27,000 psi. Polyethelyneterpthalete (PET) reinforced with 30% glass fibers has a flexural strength of 32,000–33,500 psi and a compressive strength of 25,000 psi. Thermosetting polyester material reinforced with woven glass cloth has a flexural strength of 40,000–80,000 psi and a compressive strength of 25,000–50,000 psi. All of the foregoing materials have relatively high degrees of flexibility and hardness and are capable of taking and maintaining a good cutting edge as well as providing sufficient strength to allow their use in the fabrication of the snake or cable. The foregoing data were taken from the Modern Plastics Encyclopedia, 1984–85, vol. 61, no. 10*a* published by McGraw Hill. Reference to this work or similar work will make apparent many more polymeric materials suitable for use in the present invention for the fabrication of cutter blades 22.

The cutter head 12 further includes a connector having in this case a threaded bolt 24 adapted to affix the cutter blade 22 thereto as well as a connector socket 26 adapted to connect the cutter head 12 to a cable 20, preferably by means of a mating fixture disposed upon that cable. It will be appreciated that there are many designs of mating couplers 26 presently employed to connect cutter heads to sewer cleaning cables and all of such connectors may be employed in connection with the present invention. The connector socket 26 and retaining nut 24 are preferably fabricated from a metallic material to ensure high durability under torque; however, various polymeric materials may be similarly employed.

While the cutter blade 22 of FIG. 2 has been described as being a solid body of polymeric material, and optionally including reinforcing material therein, in particular embodiments, the cutter blade 22 may be fabricated as a polymeric coated metallic body. For example, a flexible metallic core may be employed as a base upon which the polymeric, or polymeric-composite material may be disposed. In this manner, the metal will provide rigidity and flexibility to the cutter whereas the polymeric material will protect the interior of the drain line being cleaned.

It will also be appreciated that the particular design of FIG. 2 may be varied; for example, a greater or smaller number of cutter blades 22 may be similarly mounted as may be auxiliary metal cutter blades. For example, the cutter 12 of FIG. 2 may include one or more small metallic cutter blades indicated at **22*a* mounted so as to be substantially surrounded and protected by the larger polymeric cutter blades 22. In this manner, the metallic blades 22*a* will aid in cutting and macerating tough materials encountered while the more flexible polymeric blades 22** will serve to guide the advancing cable and prevent the metallic blades from contacting the wall of the drain.

Figure 3:
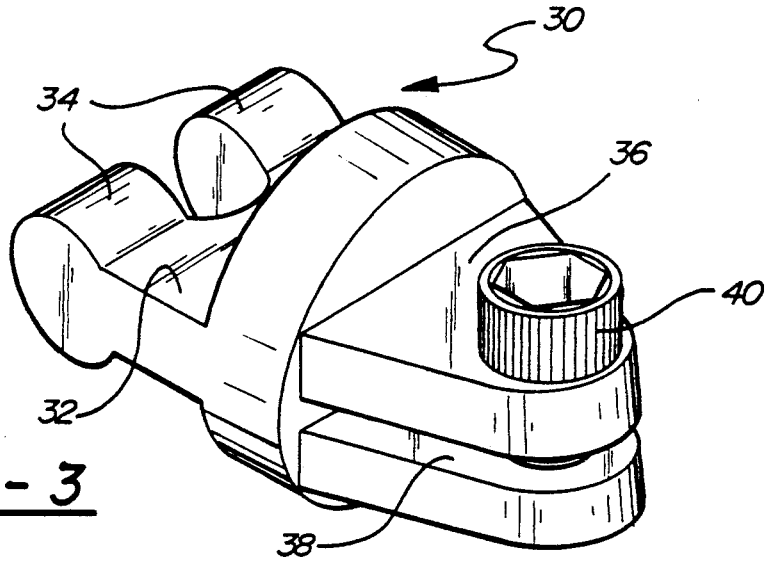
FIG. 3 is a perspective view of a connector adapted to retain a polymeric cutter blade therein.

The connector may be provided with fixed blades, or in some instances may be provided with removable blades to allow replacement thereof in case of breakage or to allow for changing blades for purposes of carrying out different cleaning operations. Referring now to FIG. 3, there is shown one particular connector 30 as adapted to retainably and removably support a polymeric cutting blade. The connector 30 of FIG. 3 is preferably fabricated from metal, or a durable polymeric material and includes a connector portion 32 adapted to matingly engage the corresponding connector on a drain cleaner cable. Toward this end it will be noted that the connector end 32 of the connector 30 includes a pair of circular protrusions 34 adapted to snap into the appropriate fitting. The connector 30 further includes a retaining portion 36 provided with a slot 38 and set screw 40 for receiving and retaining a cutter blade.

Figure 4:
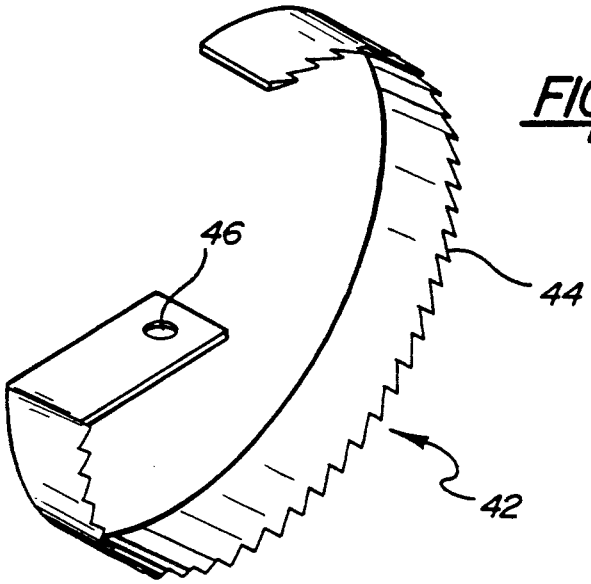
FIG. 4 is a depiction of on particular polymeric cutter blade of the present invention as adapted for use with the connector of FIG. 3; and, FIG. 5 is a depiction of another design of cutter blade adapted for use with the connector of FIG. 3.

Referring now to FIG. 4, there is shown one particular design of cutter blade 42 which may be utilized in conjunction with, and retained by, the connector 30 of FIG. 3. The blade 42 of FIG. 4 is a generally spiral saw tooth cutter of the type employed to clean the interior periphery of drain lines. The blade 42 includes a number of saw teeth 44 thereupon as well as a mounting hole 46 adapted to operate in cooperation with the retaining screw 40 of the connector 30 of FIG. 3 to retain the blade 42 therewithin.

Figure 5:
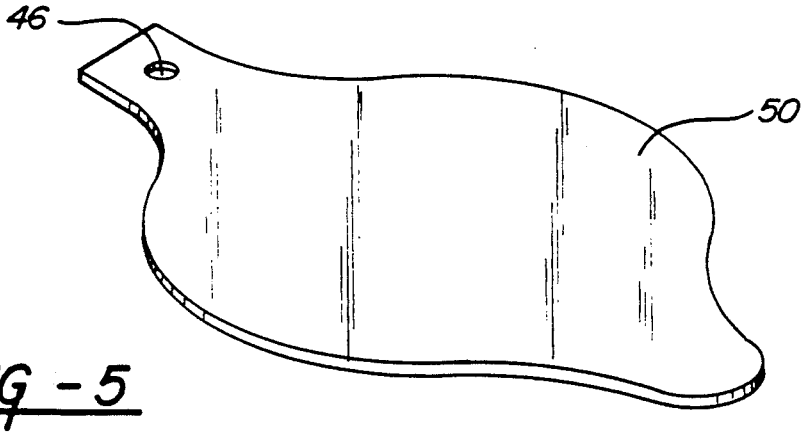

Obviously, other designs of blade may be employed with the connector 30 of FIG. 3. For example, the spade shaped blade 50 of FIG. 5 is particularly well suited for cutting through grease blockages in drain lines and may be readily affixed to the holder 30 of FIG. 3 by use of the mounting screw 40 in combination with the mounting hole 46 in the blade 50 of FIG. 5. In yet other embodiments, the spade blade 50 may be provided with serrated or saw-tooth edges. In still other instances, it will be desirable to coat at least portions of the polymeric blade with a still softer material, such as an elastomer to still further prevent damage to the drain lines.

As discussed hereinabove, the cable, or snake a polymeric material so as to lessen the likelihood of damage to polymeric drain lines. In some instances, the snake or cable may be entirely of a polymeric material, while in other instances the cable or snake may be a plastic coated metallic member. In one particular instance, the plastic coating may be in the form of a protective sleeve which is fitted about the cable before it is advanced into the drain line. A sleeve of this type can be configured to include a slit along the length thereof to facilitate its placement on a metallic snake or it may be seamless, in which case it will be separately applied to each length of the cable or snake as it is advanced As should be apparent from the foregoing, various other designs of blades may be similarly mounted in the connector 30 of FIG. 3 as well as in connectors of various other designs. The important feature of the present invention is the fact that high strength polymeric materials are employed to fabricate at least the blade portion of cutter heads used for the cleaning of polymeric drain lines.

In light of the foregoing, numerous modifications and variations of the aforedescribed invention will be readily apparent to one of skill in the art. Therefore it should be kept in mind that the preceding drawings, description and discussion are merely meant to be illustrative of particular embodiments of the present invention and not limitations upon the practice thereof. It is the following claims, including all equivalents which define the scope of the invention.

I claim:

1. An improved cutter assembly for use with a drain cleaning apparatus of the type adapted to rotatably advance a cable through a drain line, said cutter assembly comprised of:

at least one cutter blade fabricated from a synthetic polymeric material and having a metallic core therein;

a connector operative to (1) affix the cutter assembly to the cable and (2) rigidly retain said at least one cutter blade; whereby said assembly is particularly adapted to clean a polymeric drain line without damage thereto.

2. A cutter assembly as in claim 1, further including a plurality of cutter blades fabricated from a synthetic polymeric material.

3. A cutter assembly as in claim 1, wherein said cutter blade is removably retained by the connector.

4. A cutter assembly as in claim 1, wherein at least a portion of said cable is fabricated from a synthetic polymeric material.

5. A cutter assembly as in claim 1, wherein said cutter blade is fabricated from a synthetic polymeric material chosen from the group consisting of ABS, PVC, polycarbonate, PET, nylon, epoxies and combinations thereof.

6. A cutter assembly as in claim 1, wherein said cutter blade is reinforced with an inorganic material chosen from the group consisting of glass fibers, glass cloth, graphite fibers, metallic particles, and combinations thereof.

7. A cutter assembly as in claim 1, wherein said connector is a metallic connector.

8. A cutter as in claim 1, wherein said connector is fabricated from a synthetic polymeric material.

9. An improved cutter assembly for use with a drain cleaning apparatus of the type adapted to rotatably advance a cable through a drain line, said cutter assembly comprises of:

at least one metallic blade, at least one blade fabricated from a synthetic polymeric material, said polymeric blade being disposed so as to substantially prevent contact of the metallic blade with the drain line; and a connector operation to (1) affix the cutter assembly to the cable and (2) rigidly retain said blades; whereby said assembly is particularly adapted to clean a polymeric drain line without damage thereto.

* * * * *